United States Patent [19]

Shimoma et al.

[11] 4,257,024

[45] Mar. 17, 1981

[54] COLOR PICTURE TUBE APPARATUS

[75] Inventors: Taketoshi Shimoma, Isezaki; Kumio Fukuda; Michio Nakamura, both of Fukaya, all of Japan

[73] Assignee: Tokyo Shibaura Denki Kabushiki Kaisha, Kawasaki, Japan

[21] Appl. No.: 75,677

[22] Filed: Sep. 14, 1979

[30] Foreign Application Priority Data

Sep. 20, 1978 [JP] Japan ..... 53/114680

[51] Int. Cl.[3] ..... H01F 7/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 3,106,658 | 10/1963 | Chandler et al. | 335/212 X |
| 3,573,525 | 4/1971 | Fuse | 335/210 X |
| 3,763,452 | 10/1973 | Ikeuchi | 335/213 |
| 3,849,749 | 11/1974 | Kadota | 335/210 |

OTHER PUBLICATIONS

Techn. Mitt. AEG Telefunken 65, (1975), 7.

*Primary Examiner*—George Harris

*Attorney, Agent, or Firm*—Cushman, Darby & Cushman

[57] ABSTRACT

A color picture tube apparatus comprising a color picture tube and beam deflecting means surrounding the color picture tube. The color picture tube includes an in-line type electron gun and a phosphor screen with phosphor layers. Each phosphor layer emits red, green and blue light when the electron beams from the electron gun impinge upon it. The beam deflecting means includes a horizontal deflection coil for generating a horizontal deflection magnetic field, a vertical deflecting coil and correction coils. The vertical deflecting coil and the correction coils cooperate to generate a vertical deflection magnetic field. The distribution of the horizontal deflection magnetic field is barrel-shaped on the electron gun side and pincushion-shaped on the phosphor screen side and is, as a whole, pincushion-shaped. The distribution of the vertical deflection magnetic field is barrel-shaped on the electron gun side and pincushion-shaped on the phosphor screen side and is, as a whole, barrel-shaped. The correction coils serve to automatically correct both an image distortion and a convergence error at the same time.

7 Claims, 18 Drawing Figures

COLOR PICTURE TUBE APPARATUS

BACKGROUND OF THE INVENTION

This invention relates to a color picture tube apparatus, and more particularly a color picture tube apparatus provided with beam deflecting means which can automatically correct an image distortion and a convergence error.

FIG. 1 illustrates typical structure of a conventional color picture tube apparatus which comprises beam deflecting means and a color picture tube containing an electron gun of in-line type. The color picture tube is constituted by a rectangular face plate 1 with a phosphor screen 2 formed on its inner surface, a rectangular shadow mask 3 having a number of apertures through which electron beams pass, a funnel portion 4 connected to the face plate 1, and a neck portion 6 containing an electron gun 5 of in-line type. The phosphor screen 2 consists of a number of phosphor stripes which extend in vertical direction (or in FIG. 1, a direction perpendicular to the drawing sheet). When three electron beams 7 impinge upon each phosphor stripe, the stripe emits red, green and blue light, About the funnel portion 4 the beam deflecting means 8 is provided to deflect the electron beams 7 in horizontal and vertical directions so that an image is reproduced on the phosphor screen 2.

Generally, the beam deflecting means 8 not only deflects electron beams but also generates such a magnetic field as corrects a convergence error of three electron beams. The distributions of such a magnetic field are illustrated in FIG. 2A and FIG. 2B, wherein Z denotes the axis of the color picture tube, the intensity of a pincushion shaped magnetic field is plotted above axis Z, and that of a barrel shaped magnetic field of plotted below axis Z.

A horizontal magnetic field has such an intensity distribution that, as curve 9 in FIG. 2A shows, a barrel shaped magnetic field is located near the electron gun 5 and a pincushion shaped magnetic field near the phospher screen 2. On the other hand, a vertical magnetic field exhibits such an intensity distribution that, as curve 10 in FIG. 2B show, a barrel shaped magnetic field extends from the electron gun 5 to the phosphor screen 2.

With the beam deflecting means 8 generating such a magnetic field distribution it is possible to automatically correct a convergence error at the central part and edge parts of the phosphor screen 2. However, a raster formed on the phosphor screen 2 is inevitably distorted as indicated by dotted line 12 in FIG. 3. Ideally, every raster should be so rectangular as indicated by solid line 11 in FIG. 3. Usually such a raster distortion is at most about 1% in Y axis. The distortion in X axis, however, amounts to about 3% to 5% in a color picture tube of 90!-deflection and about 7% to 8% in a color picture tube of 110!-deflection. The raster distortion is acutest at the four corners 13 of the phosphor screen 2.

Various method have been invented to reduce the above-mentioned raster distortion.

The first method uses such a distortion correction circuit as illustrated in FIG. 4A. A portion of current flowing from a vertical deflection output (V output) to a vertical deflection coil (V coil) is superposed by means of a transformer T on the current which flows from a horizontal deflection output (H output) to a horizontal coil (H coil), whereby a horizontal deflection current is modulated in synchronism with the vertical deflection so as to change a distorted raster shown in FIG. 4B to a correctly shaped raster indicated by dotted line 15 in FIG. 4B. The horizontal deflection current thus modulated has such a waveform as illustrated in FIG. 4C. The use of the correction circuit of FIG. 4A, however, renders the circuit of the color television receiver complicated and increases the cost of the color television receiver.

The second method uses such a toroidal type vertical deflecting means 18 as shown in FIG. 5, which generates a magnetic field of such an intensity distribution as would simulteneously correct both a convergence error and a raster distortion. To generate such a magnetic field, the toroidal type vertical deflection coil of the means 18 must be wound at an angle on the electron gun side and at another angle on the phosphor screen side. For this purpose, the core 17 of the means 18 should have a bend portion 19 as shown in FIG. 5. However, it is difficult to wind a wire about a core having such a bent portion to form a vertical deflection coil which can generate a magnetic field of such an intensity distribution as would correct both a convergence error and a raster distortion. Beam deflecting means, if manufactured in large quantities, would have different characteristics and would therefore reproduce images of different qualities.

The third method uses a plurality of permanent magents within or in the vicinity of a beam deflecting means. The magnets generates a static magnetic field to correct a convergence error and a raster distortion. This magnetic field, however, acts locally on a raster. It is static and it is increasingly more intense toward the magents. The static magnetic field corrects such a distorted raster as shown in FIG. 4B but locally as indicated by dotted line 21 in FIG. 6. The raster thus corrected is, therefore, still distorted locally, and distortion is created at the central part of the phosphor screen 2 as illustrated in FIG. 7. Such distortion will deteriorate the quality of reproduced images.

SUMMARY OF THE INVENTION

It is an object of this invention to provide a color picture tube apparatus which can automatically correct both an image distortion and a convergence error, using beam deflecting means and not using a correction circuit or permanent magnet.

According to this invention there is provided a color picture tube apparatus comprising a color picture tube and beam deflecting means surrounding the color picture tube. The color picture tube includes an electron gun of in-line type and a phosphor screen consisting of phosphor layers. Each phosphor layer emits red, green and blue light when three electron beams from the electron gun impinge upon it. The beam deflecting means includes a horizontal deflection coil which generates a horizontal deflection magnetic field and a vertical deflection coil and correction coils which cooperate to generate a vertical deflection magnetic field. The distribution of the horizontal deflection magnetic field is barrel-shaped on the electron gun side and pincushion-shaped on the phosphor screen side, and it is as a whole pincushion-shaped. The distribution of the vertical deflection magnetic field is barrel-shaped on the electron gun side and pincushion-shaped on the phosphor screen side, and it is as a whole barrel-shaped.

DETAILED DESCRIPTION OF THE PREFERRED EMBODIMENT

Figure 8A:
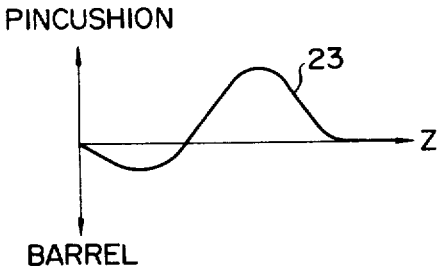
FIGS. 8A and 8B are graphs illustrating the distributions of horizontal and vertical deflection magnetic fields which can correct both an image distortion and a convergence error at the same time.
Figure 8B:
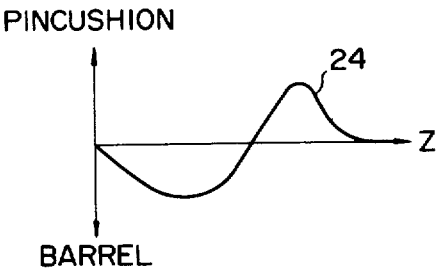

As well known, in a color picture tube provided with an electron gun of in-line type, the distributions of horizontal and vertical deflection magnetic fields should be pincushion-shaped and barrel-shaped as a whole, respectively, in order to correct a convergence error and should be both pincushion-shaped at the phosphor screen side in order to correct an image distortion. Thus, to correct both a convergence error and an image distortion at the same time it is necessary to provide a horizontal magnetic field of such a distribution as shown in FIG. 8A and a vertical magnetic field of such a distribution as shown in FIG. 8B. Upon this idea this invention is based.

The horizontal magnetic field distribution 23 shown in FIG. 8A is barrel-shaped on the electron gun side and pincushion-shaped on the phosphor screen side, and it is pincushion-shaped as a whole. The vertical magnetic field distribution 24 shown in FIG. 8B is barrel-shaped on the electron gun side and pincushion-shaped on the phosphor screen side, and it is barrel-shaped as a whole. Such a deflection magnetic field distribution can be provided by correcting the vertical deflection magnetic field distribution, using a magnetic field generated by a correction coil. More specifically, the correction coil is supplied with a current which flows in synchronism with a vertical deflection current, whereby generating a magnetic field which constitutes a part of the vertical deflection magnetic field. Both the position of the correction coil and the shape of the magnetic field generated by the correction coil depend on the shape of the vertical deflection magnetic field generated by a vertical deflection coil.

Now two deflecting means according to this invention will be described with reference to FIGS. 9 to 14. In both deflecting means, a horizontal deflecting means includes a horizontal deflection coil which is of well-known saddle type and which generates a magnetic field of such a distribution as shown by curve 23 in FIG. 8A. This horizontal deflection magnetic field is not corrected by the magnetic field generated by a correction coil. The horizontal deflection means is therefore neither illustrated nor described.

Figure 9:
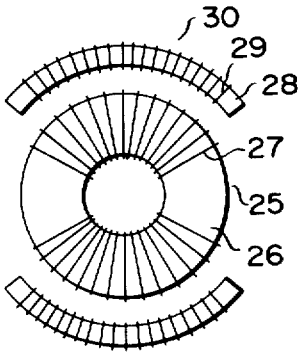
FIG. 9 is a plan view of a beam deflecting means according to this invention.
Figure 10:
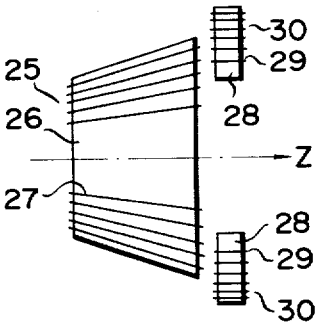
FIG. 10 is a side view of the beam deflecting means shown in FIG. 9.
Figure 11:
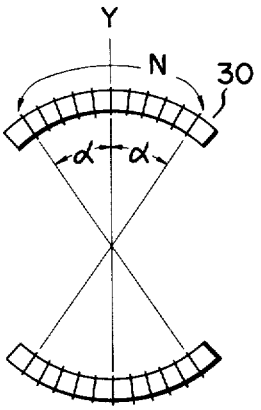
FIG. 11 is a diagram showing the structure of correction coil according to this invention.
Figure 12:
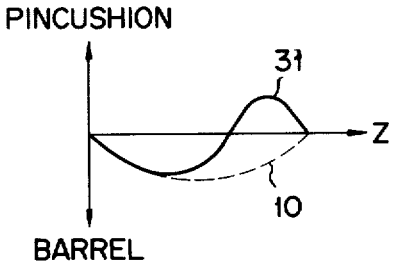
FIG. 12 is a graph illustrating the distribution of a vertical deflection magnetic field generated by the beam deflecting means shown in FIGS. 9 and 10.

FIGS. 9 and 10 illustrate a beam deflecting means according to this invention. This beam deflecting means comprises a vertical deflecting means 25 and a pair of correction coils 30. The vertical deflecting means 25 constitutes a semitoroidal deflection yoke, jointly with the horizontal deflecting means. It comprises an annular core 26 made of magnetic material and a pair of windings 27, one wound about an upper portion of the core 26 and the other about an lower portion thereof. The means 25 generates a magnetic field of such a distribution as indicated by curve 10 in FIG. 2B. The correction coils 30 are disposed closer to a phosphor screen (not shown) than the vertical deflecting means 25 and at positions which correspond to those of the windings 27, respectively. Each correction coil 30 comprises an arcuate core 28 of magnetic material and a winding 29 wound about the core 28 in toroidal fashion. The winding angle $\alpha$ of the winding 29, which is half the central angle, and the number N of turns constituting the winding 29 are determined by the type of the color picture tube, the degree of image distortion, the position of the correction coils 30, the shape of the magnetic field generated by the vertical deflection means 25, and the like. In particular, the winding angle $\alpha$ is closely related with the shape of the magnetic field that the correction coils 30 will generate, and the number N of turns determines the intensity of the magnetic field that the correction coils 30 will generate.

Figure 1:
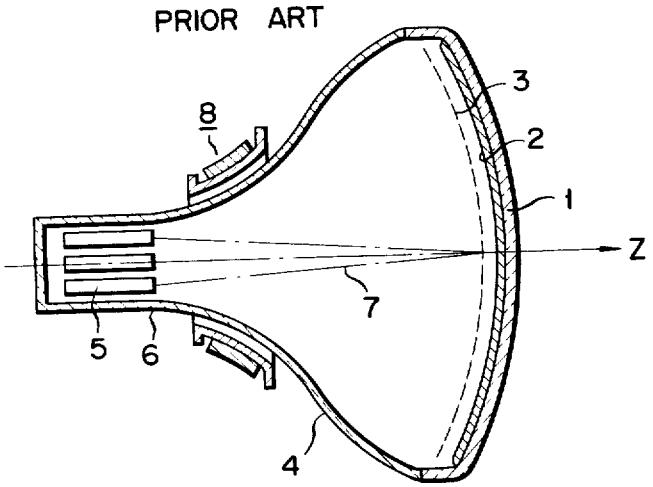
FIG. 1 PRIOR ART
FIG. 1 is a cross-sectional view of a known color picture tube apparatus containing an electron gun of inline type.
Figure 2A:
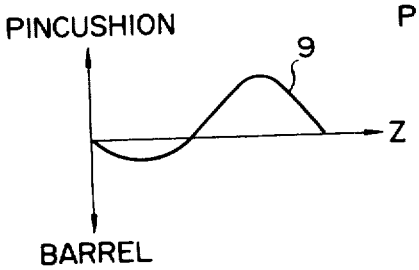
FIG. 2A PRIOR ART
FIGS. 2A and 2B are graphs showing the distributions of horizontal and vertical deflection magnetic fields generated in a known color picture tube apparatus.
Figure 2B:
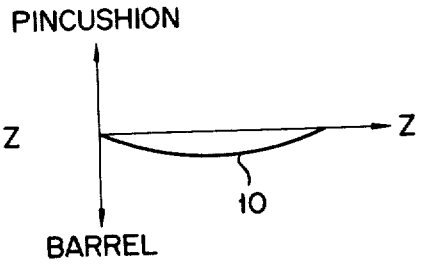
FIG. 2B PRIOR ART
Figure 3:
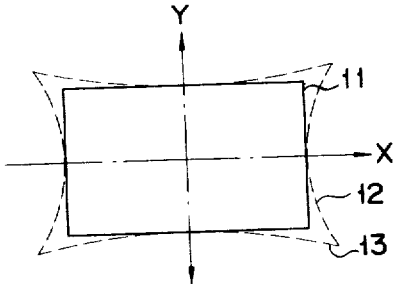
FIG. 3 PRIOR ART
FIG. 3 shows an image distorted by the distribution of deflection magnetic fields which are illustrated in FIGS. 2A and 2B.
Figure 4A:
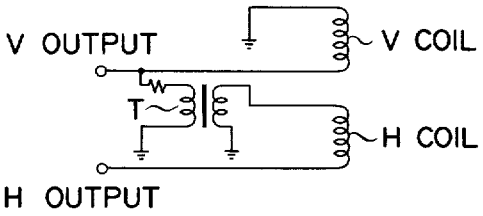
FIG. 4A PRIOR ART
FIG. 4A shows a circuit for correcting a horizontal image distortion.
Figure 4C:
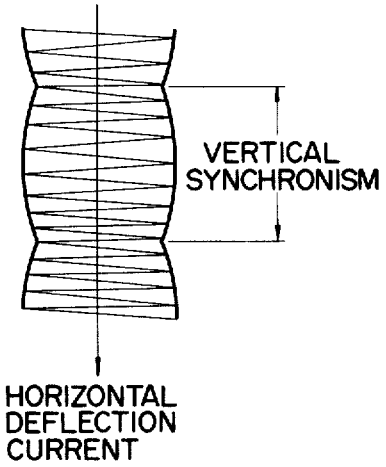
FIG. 4C PRIOR ART
FIG. 4C illustrates the waveform of a horizontal deflection current used in the circuit of FIG. 4A.
Figure 4B:
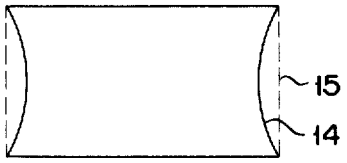
FIG. 4B PRIOR ART
FIG. 4B shows how a horizontal image distortion is corrected by the circuit of FIG. 4A.
Figure 5:
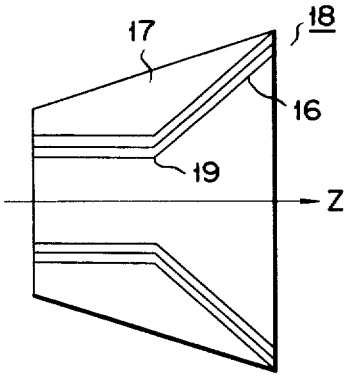
FIG. 5 PRIOR ART
FIG. 5 shows a configuration of a vertical deflecting means which can correct an image distortion.

To change the distribution of the magnetic field generated by the vertical deflecting means 25, which is barrel-shaped as shown in FIG. 2B, to such a distribution as shown in FIG. 8B, it is sufficient to shape the magnetic field generated by the correction coils 30 in the form of pincushion. Thus, only if the winding angle and the number N of turns of the coils 30 are properly chosen, it is possible to change magnetic field distribution indicated by curve 10 in FIG. 12 to such a magnetic distribution as shown by curve 31 in FIG. 12.

Figure 13:
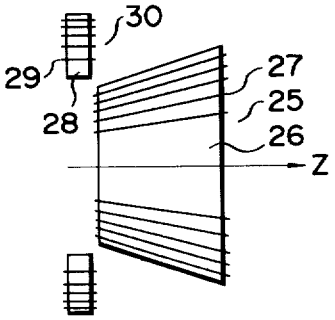
FIG. 13 is a side view of another beam deflecting means according to this invention.
Figure 14:
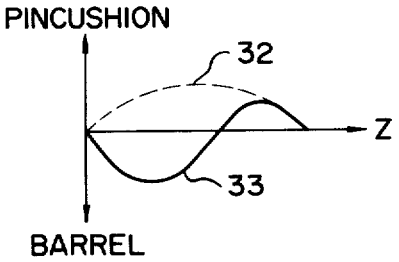
FIG. 14 is a graph showing the distribution of a vertical deflection magnetic field generated by the beam deflecting means of FIG. 13.

FIG. 13 illustrates another beam deflecting means according to this invention. This beam deflecting means differs from that of FIGS. 9 and 10 only in that a pair of correction coils 30 are disposed closer to an electron gun (not shown) than a vertical deflecting means 25. So positioned, the correction coils 30, which generates a barrel-shaped magnetic field, can change a vertical deflection magnetic field which is pincushion-shaped as illustrated by curve 32 in FIG. 14 to such a magnetic field which is barrel-shaped on the electron gun side and pincushion-shaped on the phosphor screen side as illustrated by curve 33 in FIG. 14. To provide an optimum distribution of the vertical deflection magnetic field, the winding angle α and the number N of turns of the correction coils 30 are properly chosen as in the beam deflecting means of FIGS. 9 and 10.

The correction coils 30 can easily be attached to, for instance, an insulated holder of the deflection yoke. Use of correction coils of the above-mentioned structure is advantageous in a color picture tube with an in-line type electron gun. In the above-described embodiment the core 28 of each correction coil 30 is arcuate. Instead, it may be shaped like a rod or may take another configuration. In this case, too, the correction coils 30 work in the same manner.

Figure 6:
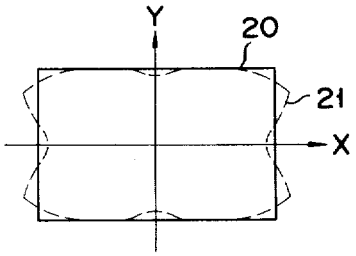
FIG. 6 PRIOR ART
FIG. 6 illustrates a distorted image which is locally corrected by means of permanent magents.
Figure 7:
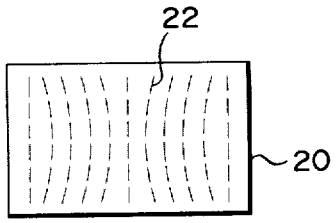
FIG. 7 PRIOR ART
FIG. 7 represents an internal distortion of an image, which occurs when permanent magnets are used to correct an image distortion.

As mentioned above, the magnetic field generated by the correction coils 30 constitutes a part of a vertical deflection magnetic field. Thus, unlike the permanent magnets used in the conventional color picture tube apparatus, the correction coils 30 do not locally act on the vertical deflection magnetic field and therefore serves to prevent such a local image distortion as illustrated in FIG. 6 and such an internal distortion as shown in FIG. 7. In addition, if its winding angle α, its number N of turns and its density distribution of turns are properly selected, each correction coil 30 may cooperate with the vertical deflecting means 25 to generate such a vertical deflection magnetic field as would correct an image distortion and a convergence error at the same time.

The beam deflecting means according to this invention comprises a commonly used vertical deflecting means and a pair of correction coils 30. The coils 30 are disposed either between the vertical deflecting means and the phosphor screen or between the vertical deflecting means and the electron gun. The structure of the beam deflecting means is simple and easily assembled without causing trouble.

With the color picture tube apparatus according to this invention it is possible to automatically correct both an image distortion and a convergence error at the same time, using a very simple beam deflecting means. The present invention is therefore of a high industrial value.

What we claim is:

1. A color picture tube apparatus comprising:

a color picture tube including an in-line type electron gun and a phosphor screen with phosphor layers each of which emits red, green and blue light when three electron beams from the electron gun impinge upon it; and beam deflecting means surrounding the color picture tube and including a horizontal deflection coil for generating a horizontal deflection magnetic field, a vertical deflection coil and correction coils, said vertical deflection coil and correction coils cooperating to generate a vertical deflection magnetic field, the distribution of said horizontal magnetic field being barrel-shaped on the electron gun side and pincushion-shaped on the phosphor screen side and, as a whole, pincushion-shaped, and the distribution of said vertical deflection magnetic field being barrel-shaped on the electron gun side and pincushion-shaped on the phosphor screen side and, as a whole, barrel-shaped.

2. The color picture tube apparatus according to claim 1, wherein the distribution of a magnetic field generated by said vertical deflection coil is barrel-shaped, said correction coils are located on the phosphor screen side at positions corresponding to that of the vertical deflection coil, and the distribution of a magnetic field generated by said correction coils is pincushion-shaped and has an intensity large enough to shape the phosphor screen side portion of the vertical deflection magnetic field like a pincushion.

3. The color picture tube apparatus according to claim 1, wherein the distribution of a magnetic field generated by said vertical deflection coil is pincushion-shaped, said correction coils are located on the electron gun side at positions corresponding to that of the vertical deflection coil, and the distribution of a magnetic field generated by said correction coils is barrel-shaped and has an intensity large enough to shape the electron gun side portion of the vertical deflection magnetic field like a barrel.

4. The color picture tube apparatus according to claim 2 or 3, wherein said horizontal deflection coil is of saddle type, and said correction coils are of toroidal type.

5. The color picture tube apparatus according to claim 4, wherein said correction coils are two coils each constituted by an arcuate core and a winding wound about the core.

6. The color picture tube apparatus according to claim 5, wherein the angle of winding, number of turns and density of turns of said correction coils are selected so that the correction coils generate a desired magnetic field.

7. The color picture tube according to any one of claims 1, wherein said correction coils are supplied with current which flows in synchronism with a vertical deflection current supplied to said vertical deflection coil.

* * * * *